US008393114B2

(12) United States Patent
Haab et al.

(10) Patent No.: US 8,393,114 B2
(45) Date of Patent: Mar. 12, 2013

(54) DEVICE WITH A CARRIAGE FOR HOLDING PANELS, CARRIAGE, RAIL AND SEPARATION ELEMENT

(75) Inventors: Gregor Haab, Allenwinden (CH); Hans Wüthrich, Wettswil (CH)

(73) Assignee: Hawa AG, Mettmenstetten (CH)

( * ) Notice: Subject to any disclaimer, the term of this patent is extended or adjusted under 35 U.S.C. 154(b) by 642 days.

(21) Appl. No.: 12/458,451

(22) Filed: Jul. 13, 2009

(65) Prior Publication Data

US 2010/0031577 A1 Feb. 11, 2010

(30) Foreign Application Priority Data

Aug. 6, 2008 (EP) ..... 08161917

(51) Int. Cl.
*E05D 15/06* (2006.01)

(52) U.S. Cl. ..... 49/425; 49/409; 16/96 R; 16/98; 16/102; 16/106

(58) Field of Classification Search ..... 49/409, 49/425; 4/607, 610; 16/96 R X, 98 X, 102 X, 16/106 X
See application file for complete search history.

(56) References Cited

U.S. PATENT DOCUMENTS

| | | | | | |
|---|---|---|---|---|---|
| 524,609 | A | * | 8/1894 | Prouty | 16/105 |
| 2,618,808 | A | * | 11/1952 | Spence et al. | 16/105 |
| 3,457,676 | A | | 7/1969 | Ziegler | |
| 3,473,266 | A | * | 10/1969 | Miller | 49/504 |
| 4,006,513 | A | * | 2/1977 | Offterdinger | 16/99 |
| 6,115,968 | A | * | 9/2000 | Sarlanis | 49/409 |
| 6,557,303 | B2 | * | 5/2003 | Finke et al. | 49/409 |
| 6,698,138 | B1 | * | 3/2004 | Lin | 49/409 |
| 7,228,659 | B2 | * | 6/2007 | Romero et al. | 49/409 |
| 7,712,258 | B2 | * | 5/2010 | Ewing et al. | 49/410 |
| 7,891,052 | B2 | * | 2/2011 | Haab et al. | 16/98 |
| 2004/0065019 | A1 | * | 4/2004 | Haab et al. | 49/409 |
| 2008/0092330 | A1 | * | 4/2008 | Haab et al. | 16/98 |

FOREIGN PATENT DOCUMENTS

| | | | | |
|---|---|---|---|---|
| CA | 2 465 041 | A1 | | 4/2004 |
| DE | 94 15 254.3 | U1 | | 12/1994 |
| DE | 20 2006 007 326 | U1 | | 10/2006 |
| EP | 1 916 370 | A1 | | 4/2008 |
| GB | 2045847 | A | * | 11/1980 |
| WO | WO 9413915 | A1 | * | 6/1994 |
| WO | WO 2007/113655 | A2 | | 10/2007 |

* cited by examiner

*Primary Examiner* — Jerry Redman
(74) *Attorney, Agent, or Firm* — Oliff & Berridge, PLC

(57) ABSTRACT

The device used to hold a separation element includes a carriage with a carriage body and at least one wheel which rolls on a running surface of a rail. The carriage is releasably connected to a mounting element which is connected to the separation element. The mounting element which is mounted laterally on an upper edge of the separation element includes a guide profile provided with a first guide surface which holds a lower and an upper flange element of the carriage body inserted therein which can be displaced along the first guide surface extending inclined by a first angle relative to the upper edge of the separation element and can be locked in an appropriate position by means of locking elements.

8 Claims, 6 Drawing Sheets a = x°
c1
c2
5a, 6a
5b 112
11
12
113
1
111
114
115
13
332
30
3
350
311
33
333
31
331
35

332
119
126
11
121
1
124
12
122
125
114
1141
113
115
332
3
33
333
331 y
x
1
124
1241
3
12
125
1251
92
351
350
333, 1141
11
62
6

DEVICE WITH A CARRIAGE FOR HOLDING PANELS, CARRIAGE, RAIL AND SEPARATION ELEMENT

CROSS-REFERENCE TO RELATED APPLICATION

This application is based on and claims priority to European Patent Application No. 08 161 917.3.

FIELD OF APPLICATION

The invention relates to a device with a carriage for holding panels, in particular glass panels; a carriage; a rail for such a device; and also a separation element provided with this device and a panel.

BACKGROUND

In order to separate or to close a room or a window opening, separation elements are often used such as sliding doors which are fixed to carriages which can be moved along a rail and may be rotatable.

A generic device with a carriage for holding a separation element is known for example from [1], EP 1 916 370 A1. In this device, the carriage comprises two carriage parts, which are anchored on both sides of the separation element and are each provided with at least one or a plurality of wheels which are guided on feet provided on the two side parts of a symmetrically designed rail. As the separation element projects into the cross-section of the rail and is held in a displaceable manner by parts of the carriage not far below the rail, the device parts are not visually disruptive, meaning that larger covering devices or bezels are not needed.

It is an object of the present invention to further improve the device known from [1], in particular the carriage and the rail.

SUMMARY

A device shall be created that requires less space. Furthermore the device should allow the separation element to be mounted closer to a wall so that requires less space and is incorporated aesthetically into a room. Furthermore the operating properties of the device, in particular the running properties of the carriage shall be further improved, in order to produce advantages in relation to smooth running and lifespan.

The inventive device should allow to thermally and acoustically insulating an area in an improved way in order to avoid thermal or acoustic bridges which prevent separation elements from being installed at locations with thermally or acoustically critical conditions.

In addition it should be possible to produce and mount the device with reduced resources.

This object is achieved with a device, a carriage, a rail and a separation element coupled to the device. Preferred embodiments of the invention are herein described.

The inventive device, which serves for holding and guiding a separation element, in particular a glass panel, comprises a mounting element and a carriage comprising a carriage body with at least one wheel that is guided on a track of a rail. For the installation of the device first the mounting element is connected to the separation element. Then the carriage is coupled to the mounting element.

According to the invention the mounting element which is mounted laterally on an upper edge of the separation element comprises a guide profile that is located on the side opposite to the separation element. The guide profile, which is provided with a first guide surface, holds a lower and an upper flange element of the carriage body, which are inserted into the guide profile. The carriage body can be displaced along a first guide surface in the guide profile and locked by means of locking elements in an appropriate position.

The inventive device has numerous advantages.

The mounting element lies laterally at the upper end for example on a glass panel and overlaps the glass panel in a preferred embodiment only with a thin flange element. The mounting element thus only requires little space in the region of the upper edge of the glass panel for the guide profile. The guide profile, which preferably corresponds at least approximately to a C-shaped profile, comprises a lower profile end element and an upper profile end element which form receiving grooves open towards each other serving to receive the flange elements of the carriage body.

The flange elements preferably form a flange plate joined integrally to the carriage body. Further it is possible to produce at least one of the flange elements or the whole flange plate separately and to connect it to the carriage body. In order to allow the dimensions of the carriage body and the manufacturing resources to be kept low, a guiding groove is preferably incorporated into the upper side of the carriage body, through which the upper flange element of the carriage body is exposed.

As the guide profile of the mounting element requires little space, only minimal dimensions are required for the mounting element in its entirety. It should further be noted that the guide profile receives a part of the carriage body. Hence, the corresponding space is used by the carriage. By pushing the carriage into the guide profile it is also ensured that the incorporated and locked carriage is also held at the level of the end region of the glass panel. Consequently, together with the carriage, the upper end region of the glass panel is also received within the rail. Hence, the device can be designed in such a way that all device parts lie within the rail and are not visible from the outside. Due to the small dimensions of the device parts and the use of a rail with only one track the dimensions of the rail can also be kept small, whereby the rail comprises a rail middle part which can preferably be connected to the ceiling. The rail middle part is connected on one side to a first rail side part, which can preferably be connected to a wall. On the other side the rail middle part is fixed or releasably connected to a second rail side part comprising said track on a lower end part, which projects into the at least approximately rectangular cross-section which is formed by the rail middle part and the rail side parts.

The separation element that is held on one side can thus be arranged with the other side at a minimal distance to a wall, on which the rail is also normally fixed.

Due to the fact that the upper region of the glass panel projects far into the rail, clearly improved insulation properties result without additional resources. Insulation gaps of existing rail systems which have to date been regarded as unavoidable can be avoided almost completely. The separation element thus serves as an acoustically and thermally effective room separator not only in the visible region but also within the rail. According to the invention it is possible with simple measures to close the area between the separation element and the rail middle part practically completely. In this respect an insulation element can additionally be provided on the separation element which cooperates with the rail middle part, possibly engaging in an insulating groove provided therein. In a further embodiment the separation element engages in such an insulating groove. The new rail technology thus opens up new fields of applications. Separation elements held by inventive devices can advantageously be used also in outside areas with thermally unfavourable conditions or for conference rooms, in which optimum sound insulation is an important factor.

In a further preferred embodiment the inventive device allows the height of the glass panel to be easily adjusted in that the mounting element is displaced in relation to the carriage that is held at a constant height in the rail. In a further embodiment a mounting element is used with a guide surface that is inclined by a first angle (a) of more than 0° in relation to the upper edge of the glass panel. As the upper flange element of the carriage body abuts against this guide surface, the displacement of the mounting element relative to the carriage thus results in a desired height displacement of the carriage relative to the separation element. The height of the separation element can thus optimally be adjusted in order to compensate for manufacturing and assembly tolerances and in particular in order to allow optimum cooperation of a preferably provided insulation element with the rail middle part, that possibly comprises an insulating groove.

In a preferred embodiment the guide profile comprises a C-shaped profile tapering in height from one end to the other, with an upper profile end element holding the upper flange element and a lower profile end element holding the lower flange element of the carriage body. The carriage thus comprises in this embodiment at least one second guide surface corresponding to the first guide surface, which second guide surface encloses together with the lower flange element a second angle b which is preferably identical to the first angle a. In this case the carriage body preferably forms as a whole a wedge element with an upper side inclined relative to the upper edge of the glass panel and a lower side which is arranged parallel to the upper edge of the glass panel. A height displacement of the glass panel relates therefore to a parallel displacement of the upper edge of the glass panel to the lower side of the carriage body.

In a basic embodiment the carriage body can be provided with wheel axles holding wheels. In a preferred embodiment the carriage is provided with a pivotally mounted wheel support. For this purpose, preferably a shaft is inserted into the carriage body which rotatably holds for example a bar-shaped support element that is provided on each side of the shaft with a wheel axle and a wheel.

The carriage can thus be divided basically into three parts, namely the carriage body, the preferably wedge-shaped flange plate, which is connected integrally or releasably on one side of the carriage body, and the wheel support preferably mounted so as to be rotatable by means of the shaft. The carriage body is dimensioned in such a way that it can firmly hold the flange plate and the shaft, which is preferably arranged perpendicular thereto, under the load of the glass panel. The dimensions of the simply constructed carriage body are thus primarily dependent upon the load to be carried, which is why the carriage body and thus the whole carriage can be realised with minimum dimensions.

In a further preferred embodiment the mounting element and the carriage body are dimensioned in such a way that the at least one wheel, but at least the wheel axle thereof, which is preferably perpendicular to a plane formed by the separation element, is positioned below the upper edge of the separation element irrespectively of the position of the carriage body within the guide profile. The wheels thus lie preferably in the upper end region of the glass panel, but do not project beyond it or only project slightly beyond it, meaning that the upper edge of the separation element can be positioned close to the middle part of the rail.

In order to allow the carriage to be fixed in a selected height adjustment the lower profile end element preferably comprises a securing bar with at least one threaded bore designed for receiving a threaded bolt, which preferably comprises an annular cutting edge can on its front side. Hence, the threaded bolt can be rotated against the carriage body, which has been inserted into the guide profile, in such a way that the first and second guide surfaces are pressed against each other. The threaded bolts of the installed mounting element are preferably arranged vertically and can therefore be tightened from below with a few hand grips.

The device parts can be made from different materials. The mounting element and the carriage body can advantageously be made from aluminium. Elements made of steel can be used for the wheel support.

BRIEF DESCRIPTION OF THE DRAWINGS

The invention is explained in greater detail below by reference to the drawings, in which.

DETAILED DESCRIPTION OF THE EMBODIMENTS

Figures 1, 1A, 1B, 1C, 1D:
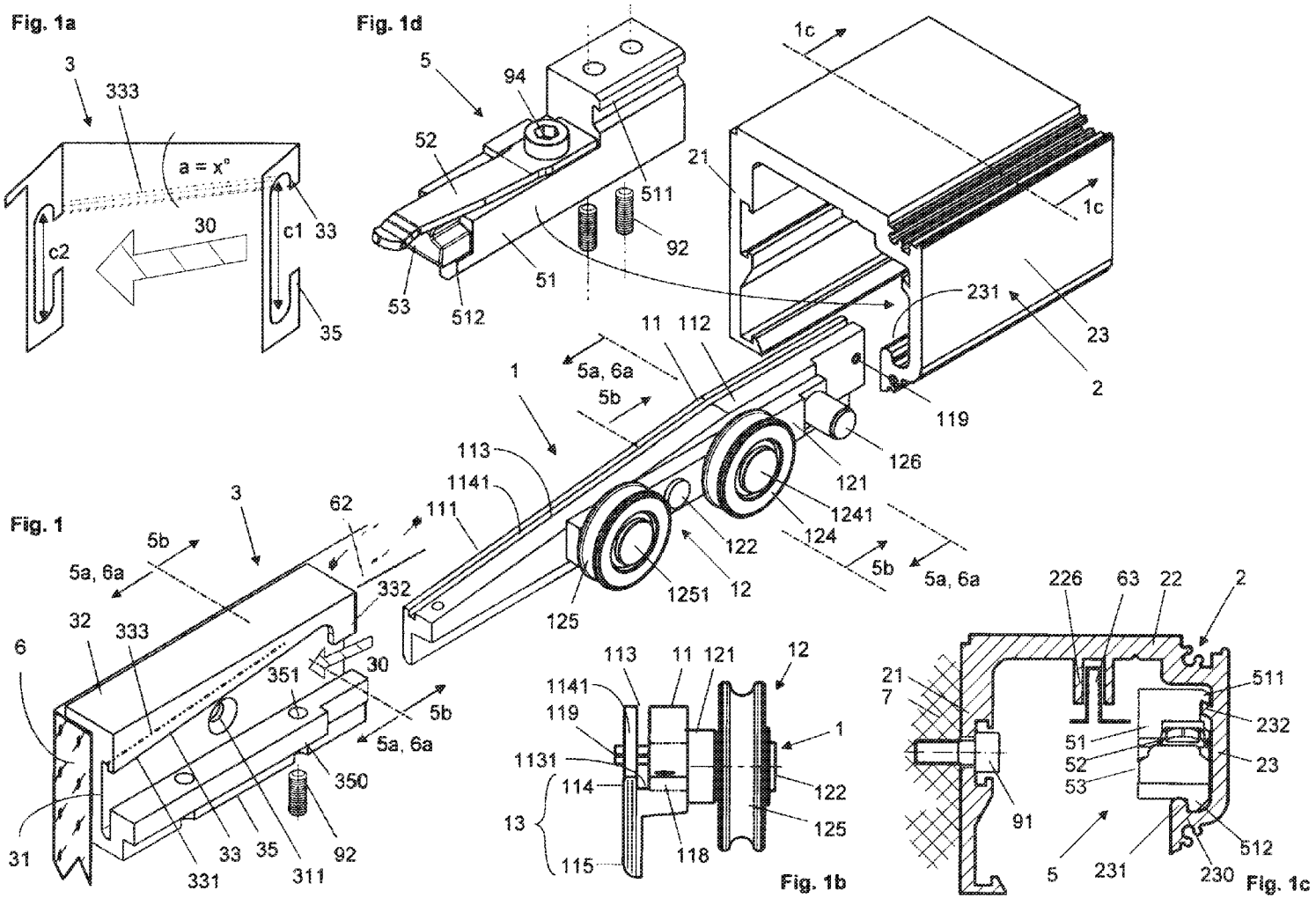
FIG. 1 shows a first inventive device with a carriage 1 which can be inserted on the one hand into a rail 2 and on the other hand into a mounting element 3 which is connected to a separation element 6, e.g. a glass panel.
FIG. 1*a* a schematic illustration of the mounting element 3 which comprises a guide profile 30 with a first guide surface 333, along which the carriage body 11 can be displaced.
FIG. 1*b* a front view of the carriage 1 of FIG. 1 with flange elements 114, 115 that can be introduced into the guide profile 30 of the mounting element 3 and a rotor 121 pivotally mounted by means of a shaft 122, with a wheel 124; 125 being arranged on the rotor 121 on each side of the shaft 122.
FIG. 1*c* the rail 2 which can be mounted on a wall in a sectional illustration with a rail middle part 22 which is connected on one side to a first rail side part 21 and on the other side to a second rail side part 23 comprising on the lower side a track 231 provided for guiding the wheels 124; 125, and supporting a buffer device 5 additionally held by a retaining rib 232.
FIG. 1*d* the buffer device 5 shown in FIG. 1*c* from the front in a spatial illustration.

FIG. 1 shows an inventive device with a carriage 1, which can be inserted on the one hand into a rail 2 and on the other hand can be coupled to a mounting element 3 which has been installed on a separation element 6, for example a glass panel.

The mounting element 3 shown schematically in FIG. 1*a* consists essentially of a C-profile-shaped guide profile 30, which comprises a profile middle element 31, an upper profile end element 33 and a lower profile end element 35, which define a receiving opening 36. The height of the receiving opening 36 decreases from one end of the guide profile 30 to the other from a first value c1 to a second value c2, whereby a first guide surface 333 is formed, which is inclined in relation to the upper edge 62 of the separation element 6. The inclination of the first guide surface 333 is thereby determined by the change in the cross-section of the upper profile end element 33, which extends continuously over the whole region. The dimensions of the lower profile end element 35 are on the other hand constant across the whole area. Hence, the lower profile end element 35 is completely parallel to the upper edge 62 of the separation element 6. The receiving opening 36 defined by the two profile end elements 33 and 35 thus has the form of a wedge-shaped sheath.

In this preferred embodiment the mounting element 3 can thus be displaced relative to the carriage 1, whereby the height of the separation element 6, i.e. the glass panel can be set. However, if the first guide surface 333 is not provided with an inclination, then the height adjustment is not possible.

The mounting element 3 further comprises an angular element 32 which encloses with the rear side of the guide profile 30 or with the profile middle element 31 an angle of 90° and which partially covers the upper side of the separation element 6. The mounting element 3 can thus be easily laid on the separation element 6 and mounted, as described in greater detail below by reference to FIG. 3.

Flange elements 114, 115 provided on the carriage body 11 can be inserted into the receiving opening 36 of the guide profile 30, whereby said flange elements 114, 115 preferably form an end-to-end flange plate 13 with the wedge-shaped front side portion forming a blade element corresponding to the receiving opening 36 of the guide profile 30.

In this preferred embodiment, the front side portion 111 of the carriage body 11 also has a wedge shape. The rear side portion 112 of the carriage body 11, in which the lower and upper flange elements 114, 115 extend in parallel, has on the other hand the form of a cuboid. In order to allow the dimensions of the carriage 1 to be kept small, the upper flange element 114 does not project over the carriage body 11 but is instead dissected by a guiding groove 113 provided in the carriage body 11. The upper side of the upper flange element 114 which forms a second guide surface 1141 corresponding to the first guide surface 333 provided on the mounting element 3 thus extends at the same height as the carriage body 11, of which the dimensions could be reduced even further with additional resources. FIG. 1 further shows that a stop pin 119 is provided at one end of the guiding groove 113, said stop pin 119 serving as a stop for the upper profile end element 33 (see FIG. 2*b*).

Furthermore a shaft 122 is provided in a bore 118 in the carriage body 11, by means of which shaft 122 a rotor 121 is rotatably held, which is provided on both sides with wheel axles 1241, 1251 and wheels 124, 125. The rotor 121 further comprises at one end a retaining bolt 126 which can be grasped and held by the buffer device 5 shown in FIGS. 1*c* and 1*d*. By using the rotor 121 it is ensured that the two wheels 124, 125 continuously lie with the same load on the track 231 of the rail 2 irrespectively of possible manufacturing and assembly tolerances. If for example the height adjustment has not been carried out precisely, with the result that the separation element 6 is not horizontally aligned, an asymmetrical load only on individual wheels is avoided. Instead an automatic load sharing on all of the wheels takes place.

It can be seen from FIG. 1*b* that the carriage 1 consists basically of the flange plate 13, the remaining carriage body 11 and a wheel support 12 which consists of the shaft 122 and the rotor 121 provided with the wheels 124, 125. The dimensions of the carriage 1 can therefore be reduced as far as permitted by the load arising through the separation element 6.

It is further shown in FIG. 1*b* that the upper side of the flange plate 13, i.e. the upper side of the upper flange element 114 forms the second guide surface 1141. The second guide surface 1141 corresponds to the first guide surface 333 provided in the mounting element 3 (see FIG. 1*a*). After installation of the separation element 6 and during the adjustment of the device these guide surfaces 1141 and 333 abut against each other and the force transmission thus also occurs via them.

After adjustment of the device the carriage body 11, particularly the flange plate 13 is pressed by means of two threaded bolts 92 against the upper profile end element 33 of the mounting element 3. The two threaded bolts 92 are in threaded bores 351 which are arranged in a securing bar 350 which is formed on the lower profile end element 35 of the mounting element 3.

FIGS. 1 and 1*c* further show the rail 2 which comprises a rail middle part 22 which is connected on one side to a first rail side part 21 and on the other side to a second rail side part 23. On the lower side of the second rail side part 23 a foot element 230 is provided with a track 231 serving for guiding the wheels 124, 125. The second rail side part 23 is further provided with a retaining rib 232 which can engage in a retaining strip 511 provided in the body 51 of the buffer device 5 shown in FIGS. 1*c* and 1*d*.

The buffer device 5 shown in a spatial illustration in FIG. 1*d*, which is supported by the track 231 and braced by means of threaded bolts 92 with the rail middle part 22, comprises a spring element 52 mounted by means of a screw 94. The spring element 52 is designed to grasp and hold the retaining bolt 126 provided on the carriage 1. Furthermore the buffer device 5 comprises an elastic stop 53, against which the part of the rotor 121 provided with the retaining bolt 126 or a part of the carriage 1 can impact, whereby the displaceable separation element 6 can be elastically received in the region of the end stop.

Figures 2A, 2B, 2C:
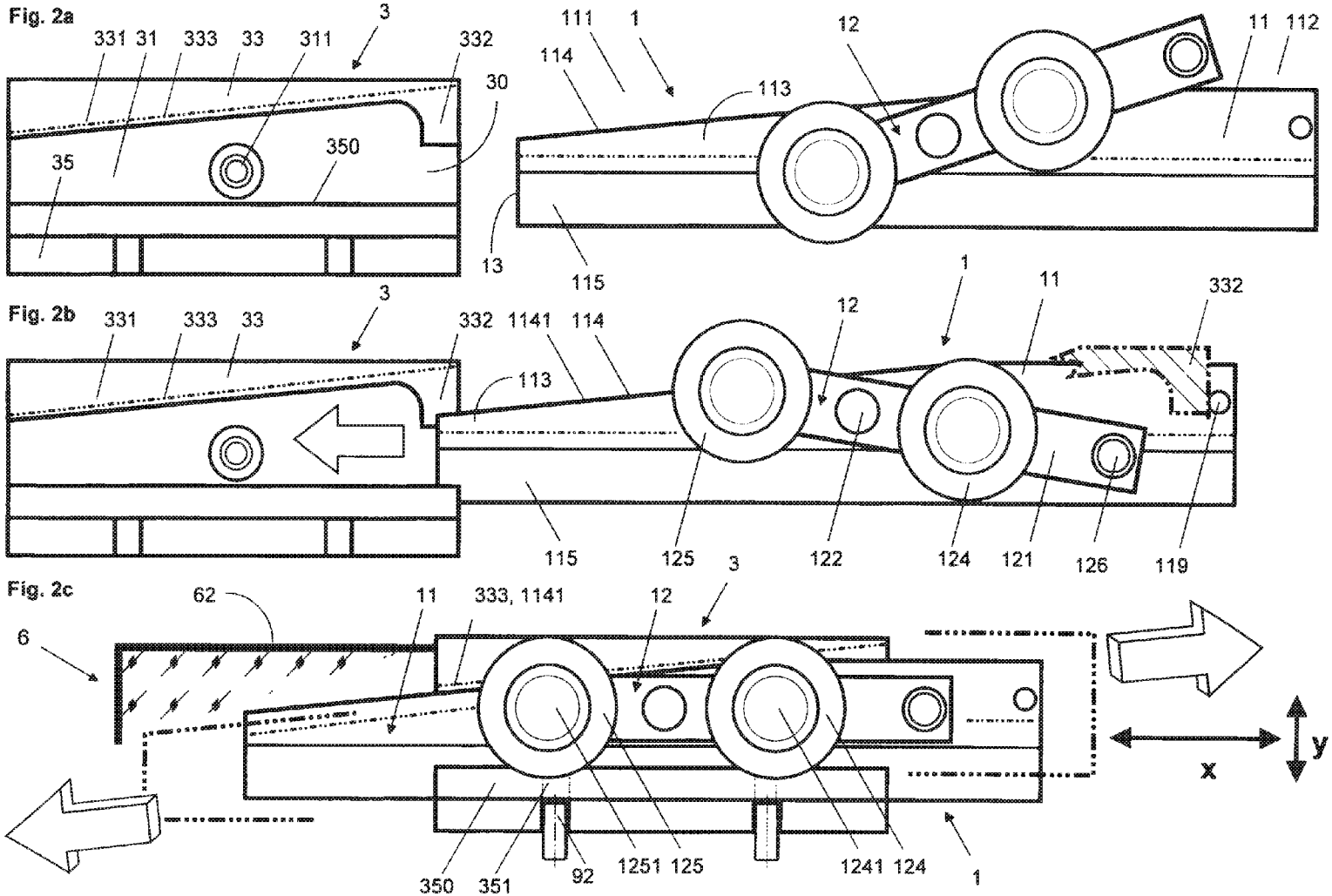
FIG. 2*a* a side view of the mounting element 3 and the carriage 1 of FIG. 1.
FIG. 2*b* the introduction of the carriage 1 into the mounting element 3.
FIG. 2*c* the height adjustment of the carriage 1, which has been introduced into the mounting element 3, relative to the upper edge 62 of the separation element 6 that has been connected to the mounting element 3.

FIG. 2*a* shows a side view of the mounting element 3 and the carriage 1 of FIG. 1. It can be seen that the first guide surface 333 of the mounting element 3, which is provided within the upper profile end element 33, and the upper flange element 114 of the carriage body 11 are inclined by the same amount, while the lower profile end element 35 and the lower flange element 115 are both aligned horizontally. The guide profile 30 forms a sheath, into which the blade like flange plate 13 (see FIG. 1*b*) formed by the upper and lower flange elements 114, 115 can be introduced.

FIG. 2*b* shows the introduction of the carriage 1, i.e. the flange plate 13, into the guide profile 30 of the mounting element 3. In order to simplify this process the front side end of the upper profile end element 33 which forms a flange is divided into an inclined first flange part 331 and an unshortened second flange part 332 which is inserted, upon introduction of the carriage 1, into the guiding groove 113 adjacent to the upper flange element 114. It is shown that the guiding groove 113 extends deeply in such a way that the flange parts 331, 332 of the upper profile end element 33 can be completely received therein. It would also be possible on the other hand to provide a third guide surface 1131 in the guiding groove 113.

FIG. 2*c* shows the height adjustment of the carriage 1 coupled to the mounting element 3 relative to the upper edge 62 of the separation element 6, on which the mounting element 3 is mounted. By a lateral displacement of the carriage 1 relative to the mounting element 3, the position thereof is also displaced in height. A lateral displacement x of the mounting element 3 relative to the carriage 1 thus leads to a height displacement y of the separation element 6 connected to the mounting element 3.

The first guide surface 333 of the mounting element 3 and the second guide surface 1141 of the carriage 1 abut against each other. While the upper flange element 114 lies in the receiving groove 361 of the upper profile end element 33 on the first guide surface 333 the lower flange element 115 of the carriage body 11 is held laterally only within the receiving groove 362 of the lower profile end element 35. The lower flange element 115 of the carriage body 11 thereby serves to absorb forces acting perpendicular to the separation element 6.

After the height adjustment of the separation element 6, threaded bolts 92 which are arranged in a securing bar 350 provided on the lower profile end element 35 are turned towards the carriage body 11. The threaded bolts 92 are preferably provided on the front side with annular cutting edges which can penetrate in a shape-locking way and fix the carriage body 11. In this way not only a force-locking but also a shape-locking connection results which guarantees that the carriage 1 is held so that it cannot be displaced.

In FIG. 2*c* it can further be seen that the carriage body 11 does not project either below or above the mounting element 3. Accordingly, the carriage body 11 does not project over the upper edge 62 of the separation element 6 either. It can further be seen that the wheel axles 1241, 1251 and even the wheels 124, 125 do not project, or only minimally project, over the upper edge 62 of the separation element 6. The upper edge region of the separation element 6, together with the carriage 1, is thus held within the rail 2 close to the rail middle part 22, so that no parts of the inventive device appear below the rail 2. By covering the free-lying parts of the rail 2 an optimal aesthetic impression can thus easily be achieved. Larger covering profiles or bezels can be avoided.

Figure 3:
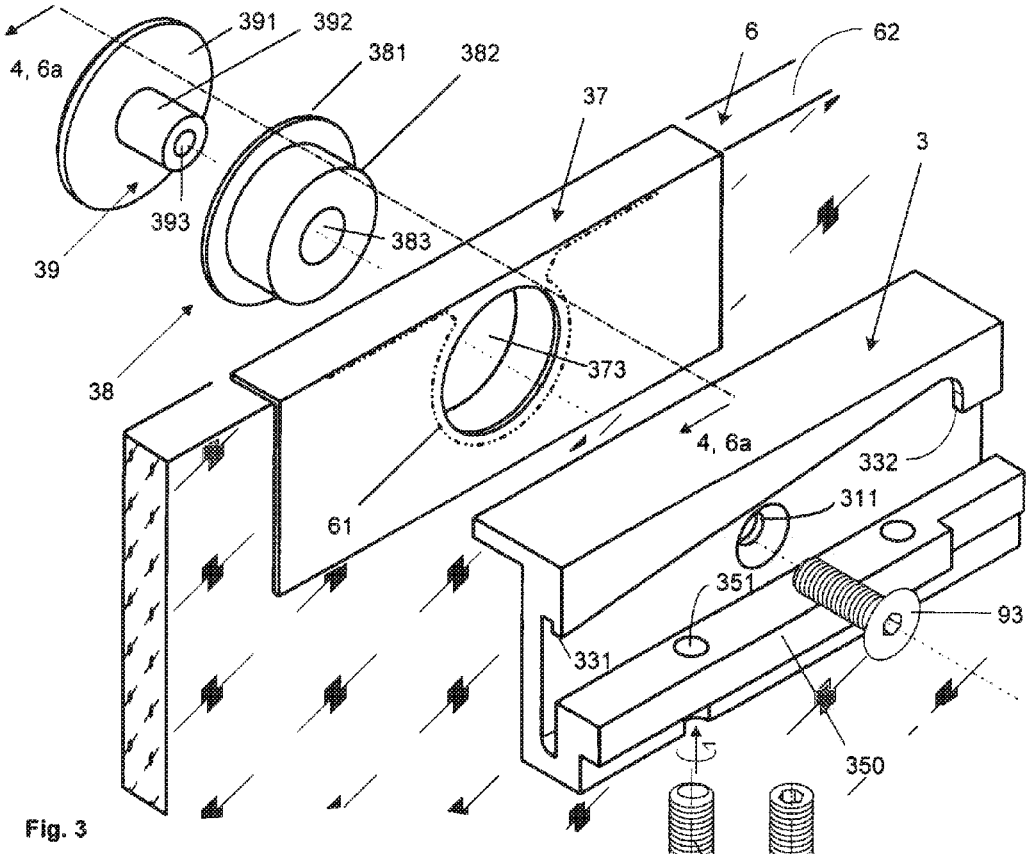
FIG. 3 in a spatial illustration, the mounting element 3 and further device parts 37, 38 and 39 serving for connecting the mounting element 3 to the separation element 6.

FIG. 3 shows the mounting element 3 and further device parts 37, 38 and 39 serving for connecting the mounting element 3 to the separation element 6. It is shown symbolically that the separation element 6 comprises an opening 61 which is covered by a protective element 37 also comprising a corresponding opening 373. A hollow cylinder 382 of a centring element 38 provided with a circular edge flange 381 is inserted into the opening 61. In the hollow cylinder 382 an inner bore 383 is provided centrically or eccentrically, into which a mounting cylinder 392 of a connecting element 39 can be inserted which is provided with a threaded bore 393 and connected to an end flange 391. The mounting element 3 can thus be installed in a simple way in that the connecting element 39 is displaced into the centring element 38 and inserted with it into the opening 61. Subsequently a connecting screw 93 is guided through an opening 311 in the mounting element 3 and turned into the threaded bore 393 of the mounting cylinder 392.

Figure 4:
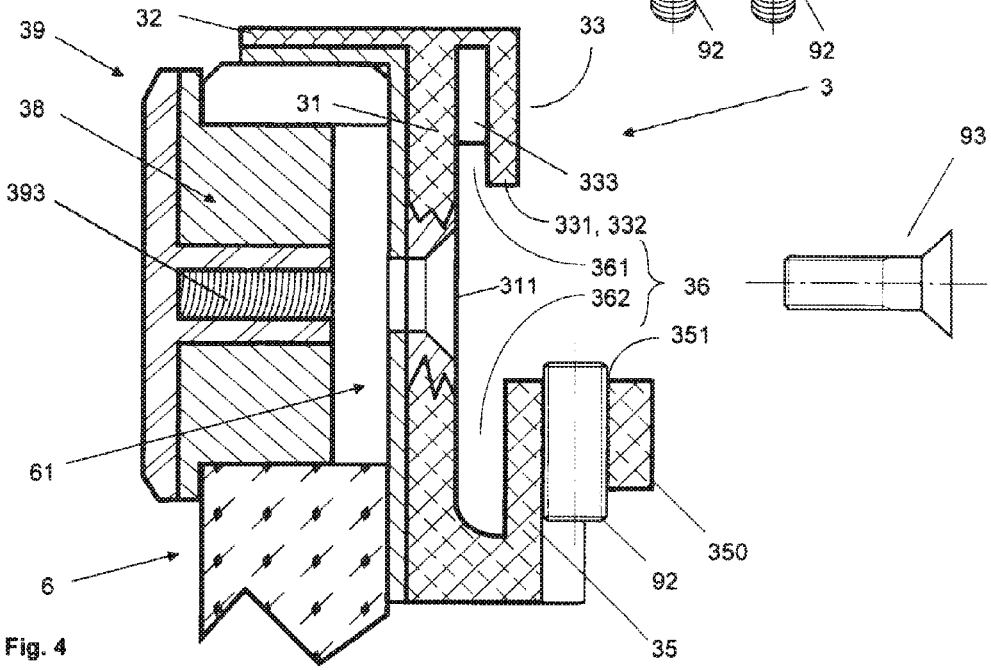
FIG. 4 in a sectional illustration, the mounting element 3 of FIG. 3 with a first guide surface 333, along which the carriage 1 is guided during the height adjustment of the separation element 6 and also the further device parts 37, 38 and 39.

FIG. 4 shows the installed mounting element 3 with the device parts 38, 39 of FIG. 3 in a sectional illustration. Clearly visible in this view are the receiving groove 362 provided in the lower profile end element 35 and the first guide surface 333 provided in the receiving groove 361 of the upper profile end element 33, along which the carriage 1 is guided during the height adjustment of the separation element 6. It can be seen that the mounting element 3 requires little space and additionally offers space (receiving opening 36) for receiving a part of the carriage body 11, namely the flange plate 13.

Figure 5A:
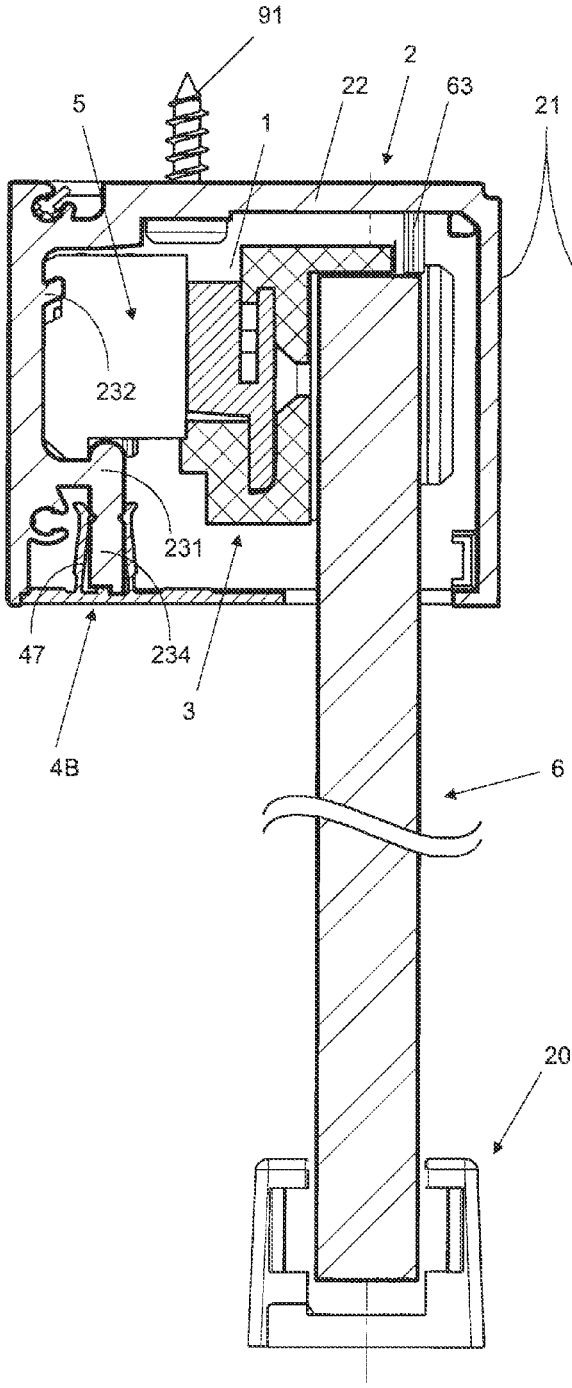
FIG. 5*a* a rail 2 connected to the ceiling, in which rail 2 a separation element 6 is held and guided by means of the carriage 1 and the mounting element 3 of FIG. 1 and in which a buffer device 5 is held between the track 231 and a retaining rib 232.

FIG. 5*a* shows a rail 2 connected to the ceiling 8 by means of a mounting screw 91. Within the rail 2 a separation element 6 is held and guided by means of the carriage 1 and the mounting element 3 of FIG. 1. Further, within the rail 2 a buffer device 5 is held between the track 231 and a retaining rib 232. It can be seen that all parts of the inventive device are arranged within the rail cross-section which is formed by the rail middle part 22 and the two rail side parts 21, 23. The carriage 1 lies almost completely above the track 231. The separation element 6 extends close to the rail middle part 22. Thus the separation element 6 divides the room completely in two sections, including the inner space of the rail 2, thus providing improved insulation.

In a preferred embodiment an insulating element 63 is additionally arranged on the separation element 6 which closes off the area between the upper edge 62 of the separation element 6 and the rail middle part 22. For example, as the insulating element 63, a brush can be placed on the separation element 6. The arrangement of a rigid or flexible insulating spring as the insulating element 63 which can engage in an insulating groove 226 provided in the rail middle part 22 is particularly advantageous. After a room opening has been closed by the separation element 6, air is thereby prevented from passing through the rail 2 from one side to the other side of the separation element 6. The air transfer and thus heat transfer through the insulating groove 226 is thereby negligible in practical terms. Furthermore, improved sound insulation is produced. Still further, there are no disruptive noises or mechanical resistance during the displacement of the insulating spring as the insulating element 63 in the insulating groove 226. The production of a rail 2 with an insulating groove 226 does not result in any additional costs either.

FIG. 5*a* also shows a cover profile 4B which is arranged on the lower side of the rail 2. The cover profile 4B is fixed by means of detent parts 47 to a holding element 234 which is formed on the track 231.

Figure 5B:
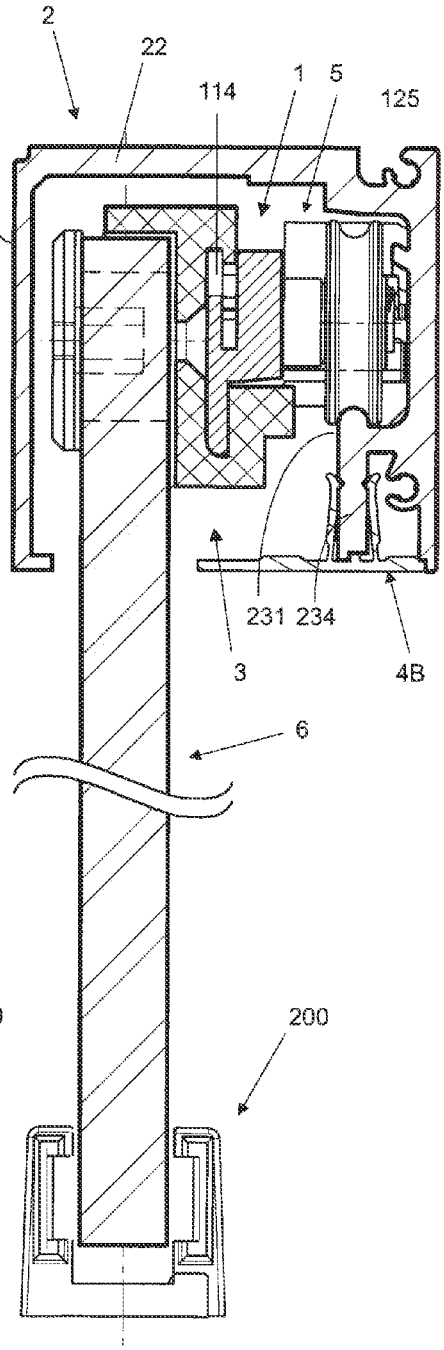
FIG. 5*b* the rail 2 and the separation element 6 of FIG. 5*a* held by means of the carriage 1 and the mounting element 3, seen from the other side.

FIG. 5*b* shows the rail 2 and the separation element 6 of FIG. 5*a* held by means of the carriage 1 and the mounting element 3 from the other side.

Figure 6A:
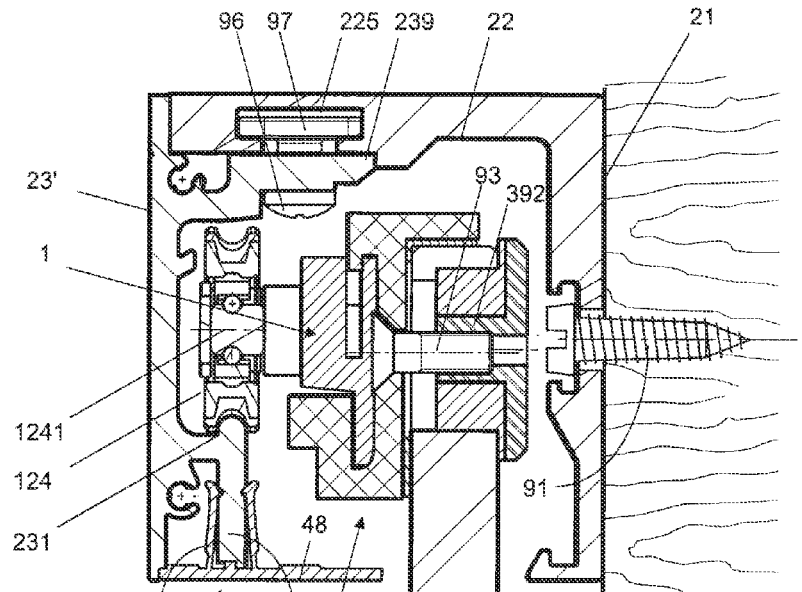
FIG. 6*a* a two-part rail 2 connected to a wall 7, in which a separation element 6 is held and guided by means of the carriage 1 and the mounting element 3 of FIG. 1.

FIG. 6*a* shows a two-part rail 2 connected to a wall 7, in which rail 2 a separation element 6 is held and guided by means of the carriage 1 and the mounting element 3 of FIG. 1. The rail middle part 22 and the first rail side part 21 connected to the wall 7 form a uniform angular profile. In the rail middle part 22 a mounting groove 225 is provided, in which a sliding block 97 provided with a thread is arranged, into which a coupling screw 96 is screwed. The second rail side part 23' provided with the track 231 comprises on its upper side a mounting wing 239 perpendicular thereto with an opening 2391 (see FIG. 6*b*) which serves to receive the coupling screw 96. The rail middle part 2 and the second rail side part 23' are fixedly connected to each other by means of the coupling screw 96 and the sliding block 97. In this embodiment of the rail 2 it is possible therefore for the uniform angular profile 21, 22 to be mounted first, while the second rail side part 23' may conveniently be mounted afterwards.

Figure 6B:
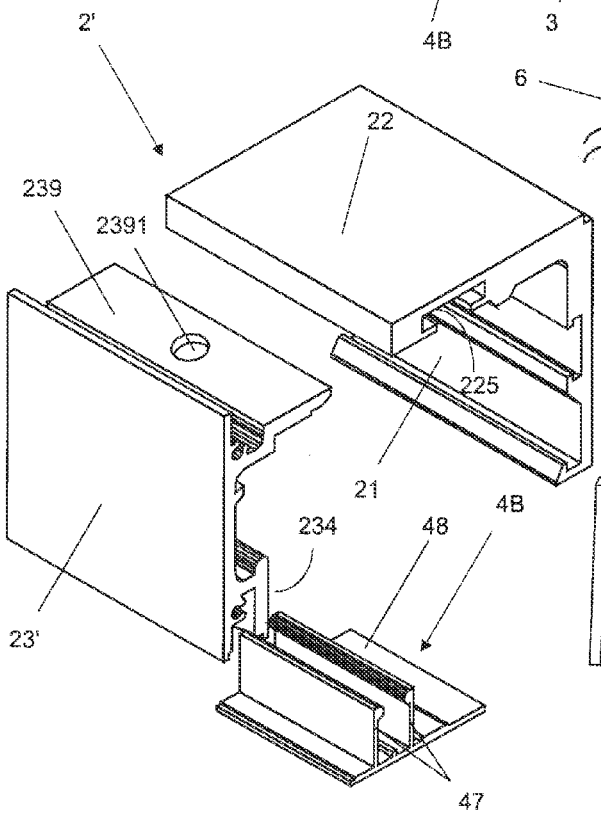
FIG. 6*b* in a spatial view, the two-part rail 2 shown in FIG. 6*a* in a sectional illustration with a second cover profile 4B.

FIG. 6*b* shows the two-part rail 2, which is shown in a sectional illustration in FIG. 6*a*, in a spatial illustration.

Figure 7A:
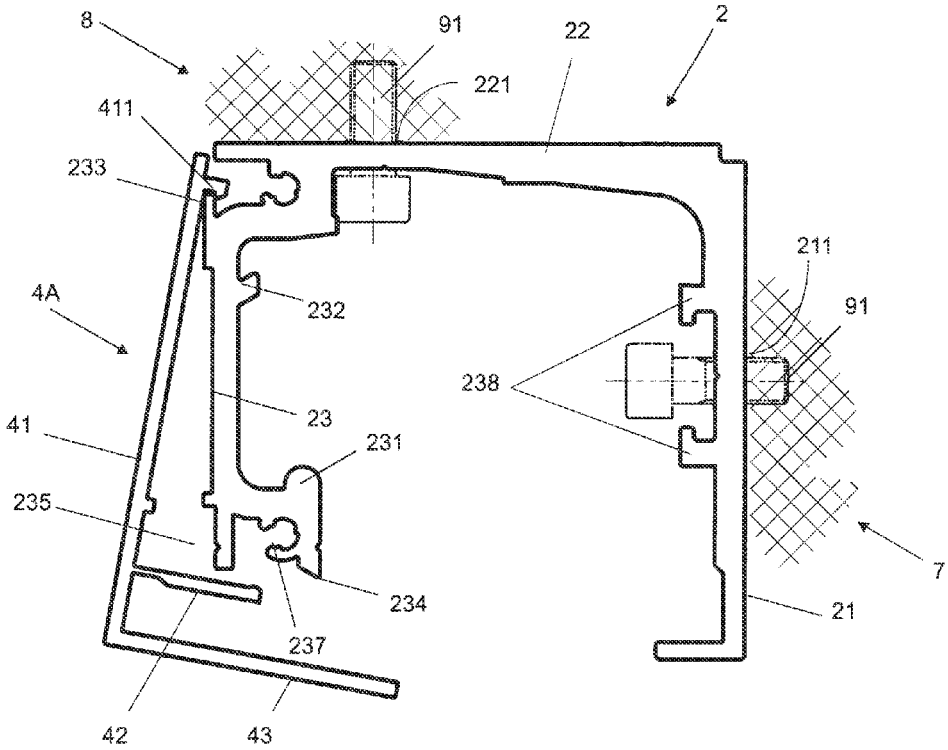
FIG. 7*a* a rail 2, which can be connected to a wall 7 or to a ceiling 8, possibly encased in concrete, in a preferred embodiment.

FIG. 7*a* shows a rail 2 which can be mounted on a wall 7 or a ceiling 8 or can be encased in concrete according to a first preferred embodiment, in which the free-lying parts of the rail 2 can be provided with a first or second cover profile 4A; 4B depending upon the type of mounting. As the rail middle part 22 and the first rail side part 21 normally abut against the wall 7 and the ceiling 8, merely the second rail side part 23 provided with the track 231 needs to be covered below and/or to the side by means of the cover profile 4A or 4B. In order to allow the cover profile 4A or 4B to be fixed the second rail side part 23 is provided on its upper side with a first and on its lower side with further holding elements 233, 234, 235.

Figure 7B:
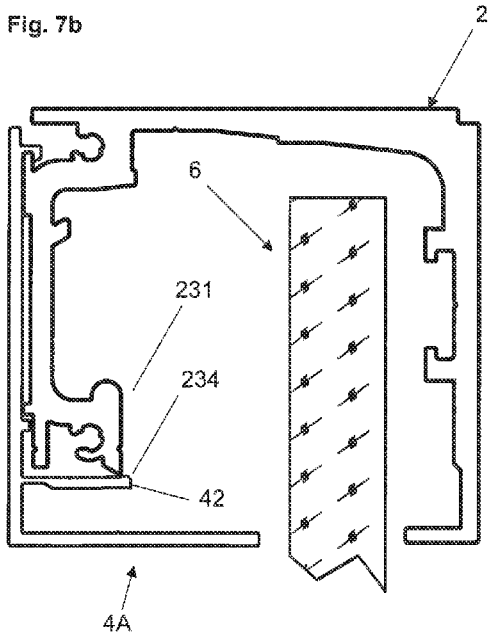
FIG. 7*b* the rail 2 of FIG. 7*a* with a first cover profile 4A which is used in the event that the rail 2 is mounted on the wall 7 or on the ceiling 8.

FIG. 7*a* shows a first cover profile 4A with an angular profile consisting of two cover parts 41, 43, which angular profile comprises a mounting hook 411 on the upper side and a detent element 42 further below. As shown in FIGS. 7*a* and 7*b*, the mounting hook 411 is hung in the first holding element 233 on the rail 2, after which the cover profile 4A is turned against the second rail side part 23 until the detent element 42 locks on one of the lower holding elements 234, which is provided on an extension of the track 231.

It is further shown in FIG. 7*a* that the rail 2 is provided with fixing elements 237, 238 and 239 extending along the rail profile. Said fixing elements 237, 238 and 239 are designed to receive coupling elements, which allow coupling of two rails 2 frontally or frontally mounting a cover device.

FIG. 7*b* shows the rail 2 of FIG. 7*a* with the mounted first cover profile 4A, which is used when mounting the rail 2 on the wall 7 or on the ceiling 8.

Figure 7C:
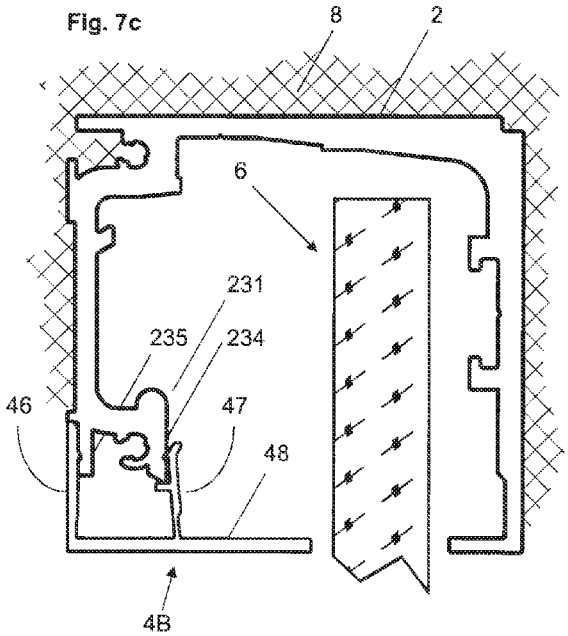
FIG. 7*c* the rail 2 of FIG. 7*a* embedded in the ceiling 8 with a second cover profile 4B which covers the area between the second rail side part 23 and the separation element 6.

FIG. 7*c* shows the rail 2 of FIG. 7*a* encased in the concrete of a ceiling 8 and having a second cover profile 4B which covers the region between the second rail side part 23 and the separation element 6. This second cover profile 4B is also an angular profile consisting of two parts 46, 48 which angular profile is held by means of a detent part 47 which presses against the holding element 234 provided below the track 231 and which pulls the part 46 against the further holding element 235. The holding elements 234, 235 preferably form together with the corresponding parts 42, 46, 47 of the cover profiles 4A, 4B snap locks which allow the relevant cover profile 4A, 4B to be connected to and disconnected from the rail 2 with little force.

Literature: [1], EP 1 916 370 A1

LIST OF REFERENCE NUMERALS

1 Carriage
11 Carriage body
111 Wedge-shaped front side portion of the carriage body 11
112 Rear side portion of the carriage body 11
113 Guiding groove
1131 Third guide surface
114 Upper flange element
1141 Second guide surface
115 Lower flange element
118 Bore for receiving the shaft 122
119 Stop pin in the carriage body 11
12 Wheel support
121 Rotor
122 Shaft
124, 125 Wheels
1241, 1251 Wheel axles
126 Retaining bolt
13 Flange plate
2 Rail
200 Bottom guide
21 First rail side part
211 Opening in the first rail side part 21
22 Rail middle part
221 Opening in the rail middle part 22
225 Mounting groove in the rail middle part 22
226 Insulating groove in the rail middle part 22
23 Fixedly arranged second rail side part
23' Releasably arranged second rail side part
230 Foot element
231 Track of the second rail side part 23
232 Retaining rib of the second rail side part 23
233, 234, 235 Holding elements
237, 238, 239 Fixing elements
239 Mounting wing of the second rail side part 23
2391 Opening in the mounting wing 239
3 Mounting element
30 Guide profile
31 Profile middle element
311 Opening for receiving the connecting screw 93
32 Angular element
33 Upper profile end element
331 First flange part of the profile end element 33
332 Second flange part of the profile end element 33
333 First guide surface
35 Lower profile end element
350 Locking element, securing bar
351 Threaded bore for threaded bolt 92
36 Receiving opening for the carriage body
361 Receiving groove in the upper profile end element 33
362 Receiving groove in the lower profile end element 35
37 Protective element
373 Opening in the protective element 37
38 Centring element
381 Circular flange
382 Centric or eccentric hollow cylinder
383 Inner bore of the hollow cylinder 382
39 Connecting element
391 End flange
392 Mounting cylinder
393 Threaded bore
4A First cover profile
41 Side part of the first cover profile 4A
411 Mounting hook
42 Detent element
43 Lower part of the first cover profile 4A
4B Second cover profile
46 Side part of the second cover profile 4B
47 Detent part
48 Lower part of the second cover profile 4B
5 Buffer device
51 Buffer body
511 Retaining strip of the buffer body 51
512 Mounting wedge of the buffer body 51
52 Retaining spring of the buffer body 51
53 Elastic stop of the buffer body 51
6 Separation element
61 Opening in the separation element 6

62 Upper edge of the separation element 6
63 Insulating element such as brush or spring
7 Wall
8 Ceiling
91 Mounting screw
92 Threaded bolt
93 Connecting screw
94 Screw for the spring element 52
96 Coupling screw
97 Sliding block

The invention claimed is:

1. Device for holding a separation element with a carriage comprising a carriage body and at least one wheel, which can be guided on a track of a rail and which is coupled to a mounting element which is connected to the separation element, wherein the mounting element, which is laterally mounted on an upper edge of the separation element comprises a guide profile provided with a first guide surface, which guide profile holds a lower flange element and an upper flange element of the carriage body that are inserted into the guide profile and that can be displaced along the first guide surface and wherein the mounting element comprises locking elements designed to lock the carriage body to the mounting element in a selected position within the guide profile.

2. Device according to claim 1, wherein the guide profile comprises a C-shaped profile tapering from one end to the other in height with a profile middle element comprising an upper profile end element that holds the upper flange element and comprising a lower profile end element that holds the lower flange element of the carriage body.

3. Device according to claim 1, wherein the upper profile end element comprises an upper receiving groove and the lower profile end element comprises a lower receiving groove and that a securing bar is formed on the lower profile end element which comprises at least one threaded bore, through which a threaded bolt can be rotated against the carriage body introduced into the guide profile.

4. Device according to claim 1, wherein the upper side of the upper flange element forms at least a second guide surface which abuts against the first guide surface, which first guide surface extends on the lower side of the upper profile end element of the guide profile.

5. Device according to claim 4, wherein the first guide surface is inclined by a first angle in relation to the upper edge of the mounting element and that the second guide surface of the carriage body is inclined by a second angle in relation to the lower flange element of the carriage body, wherein the first and second angle and are equal to or greater than 0° and smaller than 45°.

6. Device according to claim 1, wherein the carriage body is provided with a shaft pivotably holding a rotor comprising on both sides of the shaft a wheel axle, orientated perpendicular to an installed separation element, with a wheel.

7. Device according to claim 1, wherein a profile middle element of the mounting element comprises an opening for receiving a connecting screw which is inserted through a recess in the separation element into a threaded bore of a mounting cylinder, which fills the recess.

8. Carriage for a device according to claim 1 for holding and guiding a separation element along a path defined by a rail, wherein a carriage body is provided, a) which comprises on a side facing the separation element downwardly and upwardly orientated flange elements, which can be introduced into the guide profile of the mounting element mounted on the separation element, and b) which comprises on a side opposite to the flange elements a shaft that pivotally holds a support element, the support element comprising on both sides of the shaft a wheel axle provided with one of the at least one wheel.

* * * * *